US010066889B2

(12) United States Patent
Heuer

(10) Patent No.: US 10,066,889 B2
(45) Date of Patent: Sep. 4, 2018

(54) DOUBLE-BARRELED LETHAL OR NON-LETHAL SELECTABLE FIREARM

(71) Applicant: Mitch Heuer, Big Fork, MT (US)

(72) Inventor: Mitch Heuer, Big Fork, MT (US)

( * ) Notice: Subject to any disclaimer, the term of this patent is extended or adjusted under 35 U.S.C. 154(b) by 0 days.

(21) Appl. No.: 15/347,775

(22) Filed: Nov. 9, 2016

(65) Prior Publication Data

US 2017/0299308 A1 Oct. 19, 2017

Related U.S. Application Data

(60) Provisional application No. 62/252,591, filed on Nov. 9, 2015.

(51) Int. Cl.

| | |
|---|---|
| ***F41A 19/21*** | (2006.01) |
| ***F41A 3/60*** | (2006.01) |
| ***F41C 3/00*** | (2006.01) |

(52) U.S. Cl.

CPC ..... *F41A 19/21* (2013.01); *F41A 3/60* (2013.01); *F41C 3/00* (2013.01)

(58) Field of Classification Search

CPC ..... F41A 19/18; F41A 19/19; F41A 19/21; F41A 19/22; F41A 19/23; F41A 3/60

See application file for complete search history.

(56) References Cited

U.S. PATENT DOCUMENTS

| | | | | | |
|---|---|---|---|---|---|
| 1,202,707 | A | * | 10/1916 | Grieco et al. | F41A 9/69 42/7 |
| 2,041,015 | A | * | 5/1936 | Onorati | F41A 19/21 42/17 |
| 2,173,308 | A | * | 9/1939 | Miller | F41A 19/21 42/42.01 |
| 2,935,915 | A | * | 5/1960 | Janson | F41A 5/28 89/126 |

(Continued)

FOREIGN PATENT DOCUMENTS

| | | | | |
|---|---|---|---|---|
| FR | 2792064 A1 | * | 10/2000 | F21A 19/21 |
| GB | 819571 A | * | 9/1959 | F41A 19/21 |

*Primary Examiner* — Benjamin P Lee
(74) *Attorney, Agent, or Firm* — Will Hunziker

(57) ABSTRACT

A double-barreled firearm having a slide having a slide body, a first barrel, a second barrel in parallel with first barrel, a firing chamber having a first firing chamber and having a second firing chamber and a mechanism for firing only one chamber thereof. The mechanism has a selector switch having a selector switch channel, two feed bar assemblies, two extractor assemblies and a retainer. The selector rod has a proximal end, a distal end and a feed bar notch. The distal end is in rotational communication with the firing chamber. The proximal end engages with the selector switch channel such that when the selector switch is pushed from side to side, the proximal end travels along the selector switch channel causing selector rod to rotate. The two feed bar assemblies are in communication with the feed bar notch of the selector rod. Each of the two feed bar assemblies have (Continued)

a feed bar face. The two extractor assemblies are in communication with the selector rod. Each of the extractor assemblies has an extractor claw and a claw pushrod. A linkage is in communication with each of the claw push rods. The retainer is in communication with the distal end of the selector rod and with the firing chamber.

2 Claims, 6 Drawing Sheets

(56) References Cited

U.S. PATENT DOCUMENTS 4,805,332 A * 2/1989 Perazzi ..... F41A 19/21 42/42.01
4,867,039 A * 9/1989 Dobbins ..... F41A 9/35 42/18
5,074,068 A * 12/1991 Perazzi ..... F41A 19/21 42/42.01
5,809,682 A * 9/1998 Richert ..... F41A 19/21 42/117
6,135,005 A * 10/2000 Dobbins ..... F41A 3/18 42/17
8,495,831 B1 * 7/2013 Kohout ..... F41C 3/00 42/42.03
8,997,390 B1 * 4/2015 Heizer ..... F41A 3/58 42/42.03
9,015,979 B2 * 4/2015 Safewright, Jr. ..... F41A 9/72 42/49.01
9,115,954 B1 * 8/2015 Corsi ..... F41C 7/02
2006/0053672 A1 * 3/2006 Popikow ..... F41A 19/21 42/42.01
2011/0072704 A1 * 3/2011 Teach, Jr. ..... F41A 3/58 42/8
2013/0174459 A1 * 7/2013 Moretti ..... F41A 17/60 42/69.01
2014/0000143 A1 * 1/2014 Safewright, Jr. ..... F41A 9/71 42/49.02

* cited by examiner

DOUBLE-BARRELED LETHAL OR NON-LETHAL SELECTABLE FIREARM

CROSS-REFERENCE TO RELATED APPLICATIONS

This application claims the benefit of, and priority to, U.S. Provisional Patent Application Ser. No. 62/252,591, also entitled "Double-Barreled Lethal Or Non-Lethal Selectable Firearm," filed on Nov. 9, 2015.

TECHNICAL FIELD

The present disclosure technically relates to the field of firearms. More particularly, the present disclosure technically relates to firearms configured for projecting a plurality of ammunition types. Even more particularly, the present disclosure technically relates to firearms configured for projecting a plurality of ammunition types involving non-lethal ammunition.

BACKGROUND

In the related art, a double-barreled handgun has been described, e.g., in U.S. Patent Publication No. 2012/0291324, issued to Bandini, involving a double-barreled handgun that fires both chambers simultaneously. U.S. Pat. No. 1,202,707, issued to Grieco, involves a double-barreled handgun that fires from one of the two barrels at a time and allows the user to selectively choose which barrel from which to fire. The Grieco firearm, however, utilizes a shaft to engage one of two hammers in order to prevent the firing from both barrels. This shaft extends beyond the contour of the firearm and can be easily damaged and rendered inoperable. Further, in order to prevent ammunition from entering the chamber of the non-firing barrel, the Grieco firearm utilizes manually controlled stop plates. Accordingly, the Grieco handgun is prone to damage and inoperability. Therefore, a need exists for a double-barreled handgun that addresses the shortcomings in the related art.

SUMMARY

The present disclosure is directed toward solving the challenges experienced in the related art and provides alternative solutions to the implementation of non-lethal ammunition. The present disclosure is generally directed toward firearms; and the present disclosure is further directed toward a double-barreled firearm capable of firing either lethal or non-lethal ammunition. In general, the present disclosure is directed toward a double-barreled handgun that is capable of firing either lethal or non-lethal ammunition from either of two firing chambers. In particular, the present disclosure is directed toward a mechanism for firing a round of ammunition from one chamber of two chambers while preventing the discharge of another round of ammunition from the non-firing chamber, progressing ammunition selectively between the two chambers, and for selecting the firing chamber from the two chambers.

In an embodiment of the present disclosure, a double-barreled firearm comprises a slide having a slide body, a first barrel, a second barrel parallel with first barrel, a firing chamber assembly comprising a first firing chamber, a second firing chamber, and a mechanism for selectively firing only one chamber of the first and second firing chambers. The mechanism comprises a selector switch, the selector switch comprising a selector switch channel, a selector rod having a proximal end and a distal end, and a feed bar notch. The distal end is in rotational communication with the firing chamber assembly. The proximal end of the selector switch engages with the selector switch channel such that, when the selector switch is pushed from side to side, the proximal end travels along the selector switch channel, whereby the selector rod is rotatable.

In an embodiment of the present disclosure, the selector rod comprises a feed bar notch; and the mechanism further comprises two feed bar assemblies in communication with the feed bar notch of the selector rod. Each feed bar assembly of the two feed bar assemblies comprises a feed bar face. The mechanism further comprises two extractor assemblies in communication with the selector rod. Each extractor assembly of the extractor assemblies comprises an extractor claw and at least one claw pushrod. A linkage is in communication with each claw push rod of the at least one claw push rod.

In an embodiment of the present disclosure, the double-barreled firearm further comprises a retainer in communication with the distal end of the selector rod and in communication with the firing chamber assembly. The retainer is configured to prevent ammunition, such as a cartridge, from exiting the firing chamber assembly while a bolt is cycled. In another embodiment of the present disclosure, the first barrel and the second barrel are configured to accommodate the same caliber of ammunition. In another embodiment of the present disclosure, the first barrel and the second barrel are configured to accommodate a different caliber of ammunition.

The following description of the several figures of the Drawing and the Detailed Description, provide various further alternative embodiments and are also encompassed by the present disclosure; and all of the embodiments described herein are to be considered within the scope and spirit of the present disclosure.

BRIEF DESCRIPTION OF THE DRAWING

The above, and other, aspects, features, and advantages of several embodiments of the present disclosure will be more apparent from the following Detailed Description as presented in conjunction with the following several figures of the Drawing.

Figure 1:
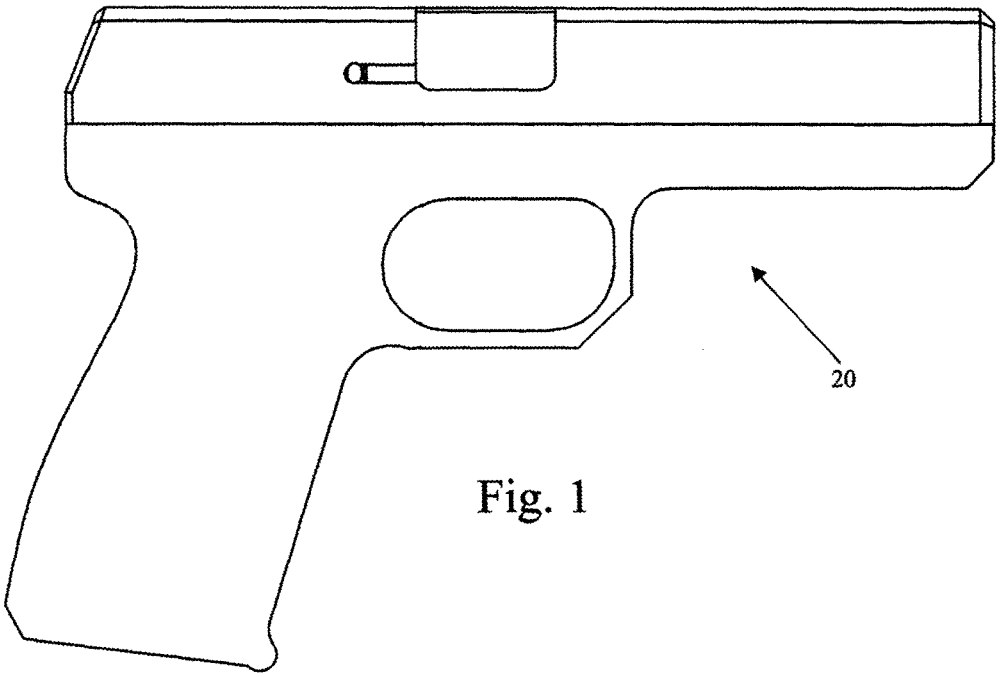
FIG. 1 is a diagram illustrating a side view of a double-barreled firearm, comprising a slide, in accordance with an embodiment of the present disclosure.

Corresponding reference characters indicate corresponding components throughout the several figures of the Drawing. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood, elements that are useful or necessary in commercially feasible embodiment are often not depicted in order to facilitate a less obstructed view of these various embodiments of the present disclosure.

DETAILED DESCRIPTION

The following description is not to be taken in a limiting sense, but is made merely for the purpose of describing the general principles of exemplary embodiments, many additional embodiments of this disclosure are possible. Understood is that no limitation of the scope of the disclosure is thereby intended. The scope of the disclosure should be determined with reference to the Claims. Reference throughout this Specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this Specification may, but do not necessarily, all refer to the same embodiment.

Further, the described features, structures, or characteristics of the present disclosure may be combined in any suitable manner in one or more embodiments. In the Detailed Description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth, and that doing is encompassed within the present disclosure. In other instances, well-known structures, materials, or operations are not shown or described in detail to avoid obscuring aspects of the present disclosure. Any alterations and further modifications in the illustrated devices, and such further application of the principles of the present disclosure, as illustrated herein, are contemplated as would normally occur to one skilled in the art to which the disclosure relates and would be also be encompassed by the present disclosure.

Unless otherwise indicated, the several figures of the Drawing are intended to be taken, e.g., arrangement of parts, proportion, degree, etc., together with the Specification, and are to be considered a portion of the entire written description of the present disclosure. As used in the following description, any terms, such as "horizontal," "vertical," "left," "right," "up," and "down," as well as adjectival and adverbial derivatives thereof, such as "horizontally," "rightwardly," "upwardly," etc., simply refer to the orientation of the illustrated structure as a particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" denote positioned or supported on, but not necessarily in direct contact with a surface.

The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The term "a" or "an" element refers to one or more of such element. As such, the term "a," or "an", "one or more," or "at least one" can be used interchangeably herein. Noted is that the terms "comprising," "including," and "having" can be used interchangeably.

Referring to FIG. 1, this diagram illustrates, in a side view, a double-barreled firearm 20, comprising a slide, in accordance with an embodiment of the present disclosure.

Figure 2:
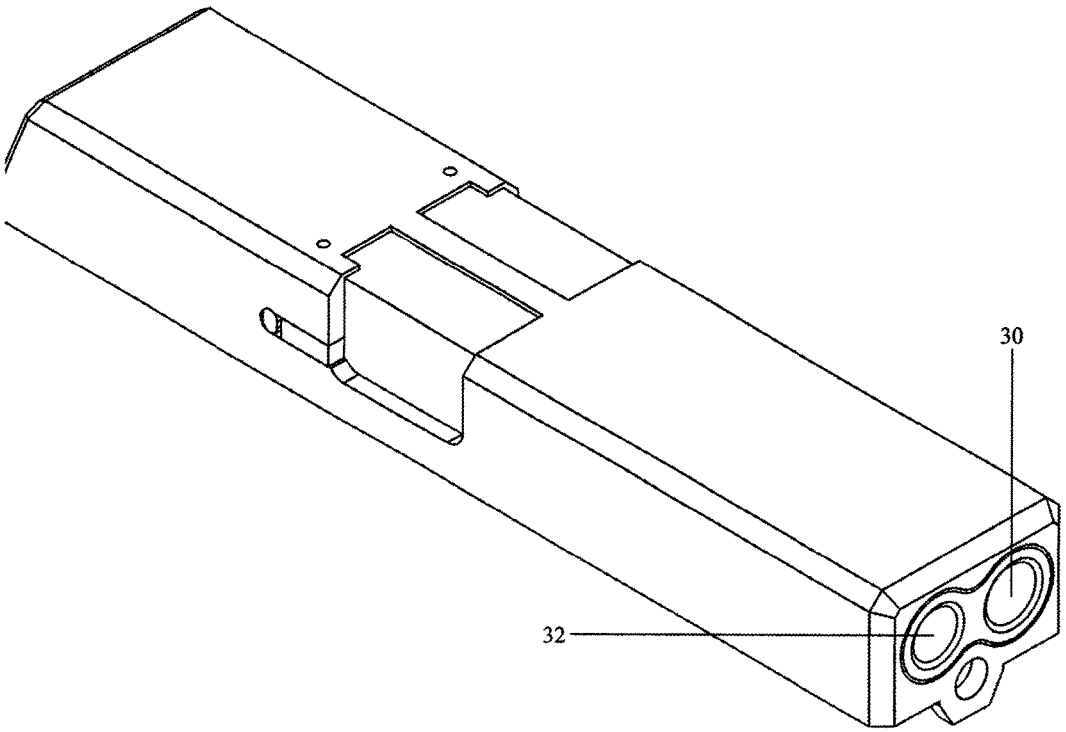
FIG. 2 is a diagram illustrating a top perspective view of a slide of a double-barreled firearm, in accordance with an embodiment of the present disclosure.

Referring to FIG. 2, this diagram illustrates, in a top perspective view, a slide 22 of a double-barreled firearm 20, in accordance with an embodiment of the present disclosure. A first barrel 30 comprises a first firing chamber 30A; and a second barrel 32 comprises a second firing chamber 32A in parallel with first barrel 30 and first firing chamber 30A. The first barrel 30 and the second barrel 32 need not fire the same size or caliber ammunition, such as rounds.

Figure 3:
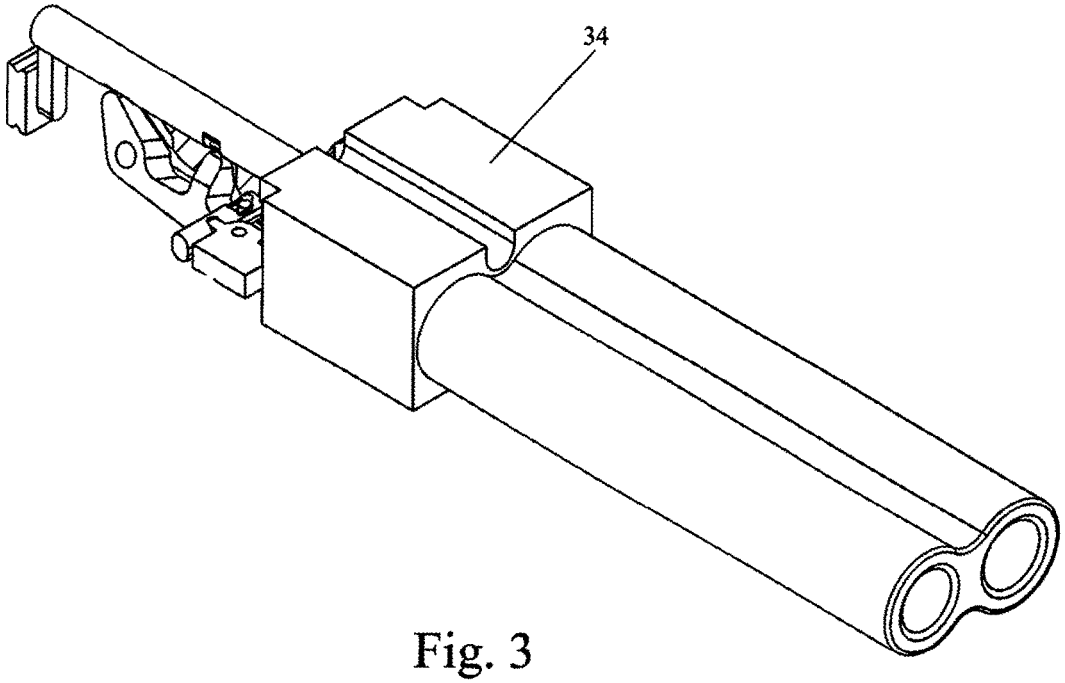
FIG. 3 is a diagram illustrating a top perspective view of a mechanism of a double-barreled handgun barrel and components, in accordance with an embodiment of the present disclosure.

Referring to FIG. 3, this diagram illustrates, in a top perspective view, a mechanism 33 of the double-barreled firearm 20, in accordance with an embodiment of the present disclosure. The slide 22 and other various components of the doubled-barreled firearm 20 are not shown in FIG. 3 in order to better illustrate the mechanism 33 for firing only one of the two chambers of the double-barreled handgun 20. The first barrel 30 and second barrel 32 are connected in a double-barreled 34 arrangement.

Figure 4:
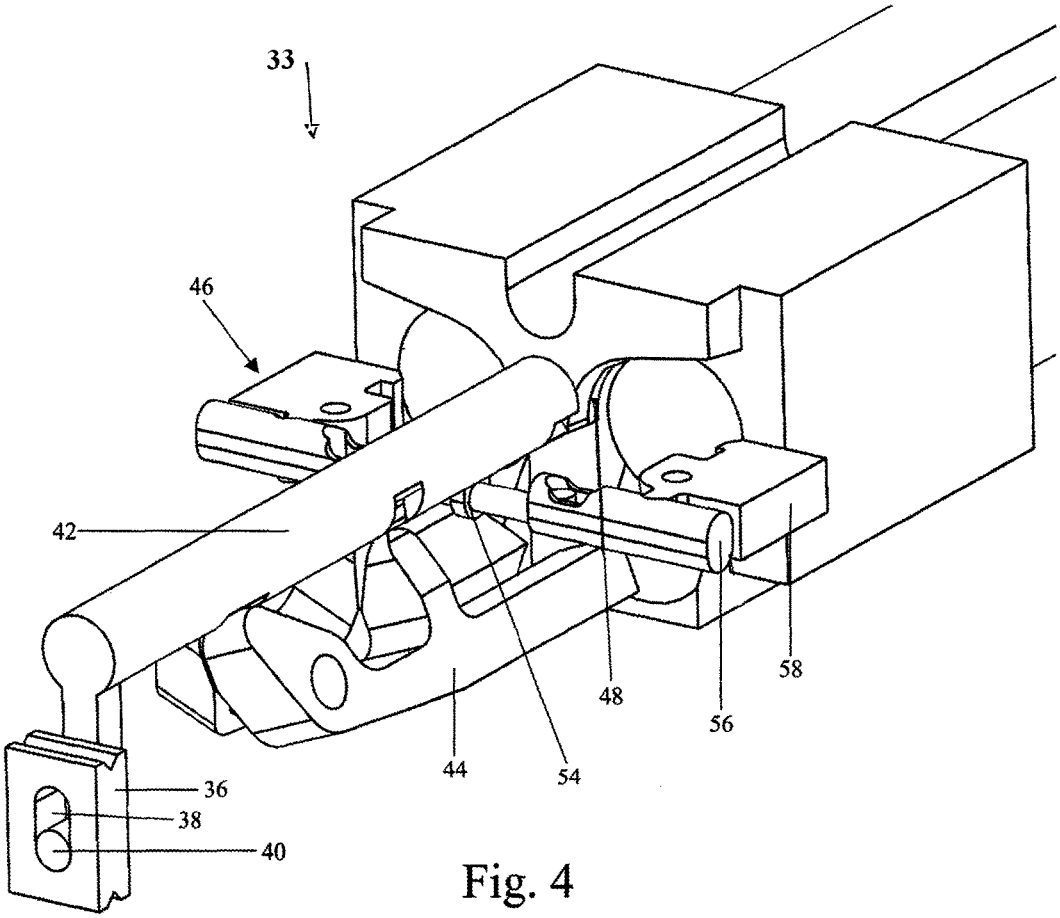
FIG. 4 is a diagram illustrating a top rear perspective view of a mechanism of a double-barreled firearm, in accordance with an embodiment of the present disclosure.

Referring to FIG. 4, this diagram illustrates, in a rear top perspective view, a mechanism 33 of the double-barreled firearm 20, in accordance with an embodiment of the present disclosure. The mechanism 33 facilitates selection of a chamber of the two chambers which will fire ammunition and also prevents the discharge of ammunition in the non-fired or non-selected chamber. Further, the mechanism 33 "progresses" or urges ammunition from a magazine into the selected chamber.

Figure 5:
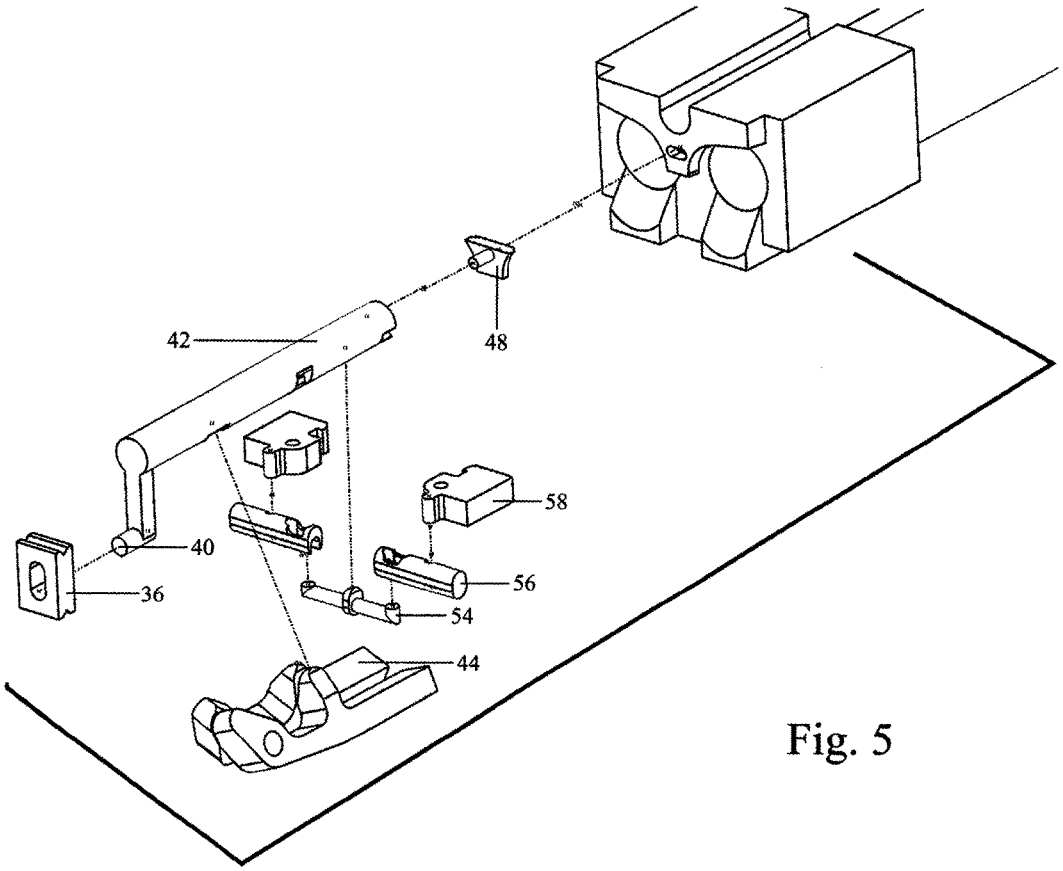
FIG. 5 is a diagram illustrating an exploded top rear perspective view of a mechanism of a double-barreled firearm, in accordance with an embodiment of the present disclosure.

Referring to FIG. 5, this diagram illustrates, in an exploded perspective view, a mechanism 33 of a double-barreled firearm 20, in accordance with an embodiment of the present disclosure. The mechanism 33 comprises a selector switch 36, the selector switch 36 comprising a selector switch channel 38 and operable for selecting a barrel of the two barrels to which ammunition is to be fired, wherein the ammunition comprises one of lethal ammunition and non-lethal ammunition. In this embodiment, the selector switch 36 is integrable with, or configured to couple with, a hammer assembly (not shown), of the firearm 20 located at the rear, above the grip. The hammer disposable in a casing configured to slide from one barrel to the other barrel, thereby selecting a barrel of the two barrels from which ammunition will be fired, and thereby preventing firing of ammunition from the non-selected barrel.

Still referring to FIG. 5, the mechanism 33 also includes a selector rod 42 which has a proximal end 40. The proximal end 40 engages a selector switch channel 38 such that, when selector switch 36 is pushed from side to side, the proximal end 40 travels along the selector switch channel 38, thereby causing selector rod 42 to rotate. The mechanism 33 further comprises two extractor assemblies 44, two feed bar assemblies 46, and one retainer 48, all of which are in communication with the selector rod 42.

Still referring to FIG. 5, new rounds of ammunition are loaded into the chambers by two feed bar assemblies 44. However, loading new rounds of ammunition can be achieved a variety of ways, depending on machining cost and complexity adjustments. The feed bar assemblies 44 extract fresh cartridges (new rounds of ammunition) from a magazine and insert the fresh cartridges into the corresponding chambers as the slide is moved forward. Since a new or fresh round is unwanted in the non-firing barrel for at least that the corresponding cartridge side is not yet spent, the firearm 20 prevents additional/unnecessary or destructive loading in relation to the non-firing barrel, e.g., at least by disposing an unneeded feed bar assembly 44 of the feed bar assemblies 44 into the slide body 22, e.g., into a feed bar notch 50 of a selector rod 42. By disposing the unneeded feed bar assembly 44 of the feed bar assemblies 44 in relation to the feed bar notch 50 in the selector rod 42, a feed bar 52 face is not disposed directly behind the cartridge in the magazine, whereby the cartridge is prevented from being pushed forward into the chamber corresponding to the non-firing barrel as the slide body 22 is moved forward. Regardless of the actual components and specific configurations as herein described, disabling one feed bar while enabling the other feed bar is encompassed by the present disclosure using any suitable structure.

Figure 6:
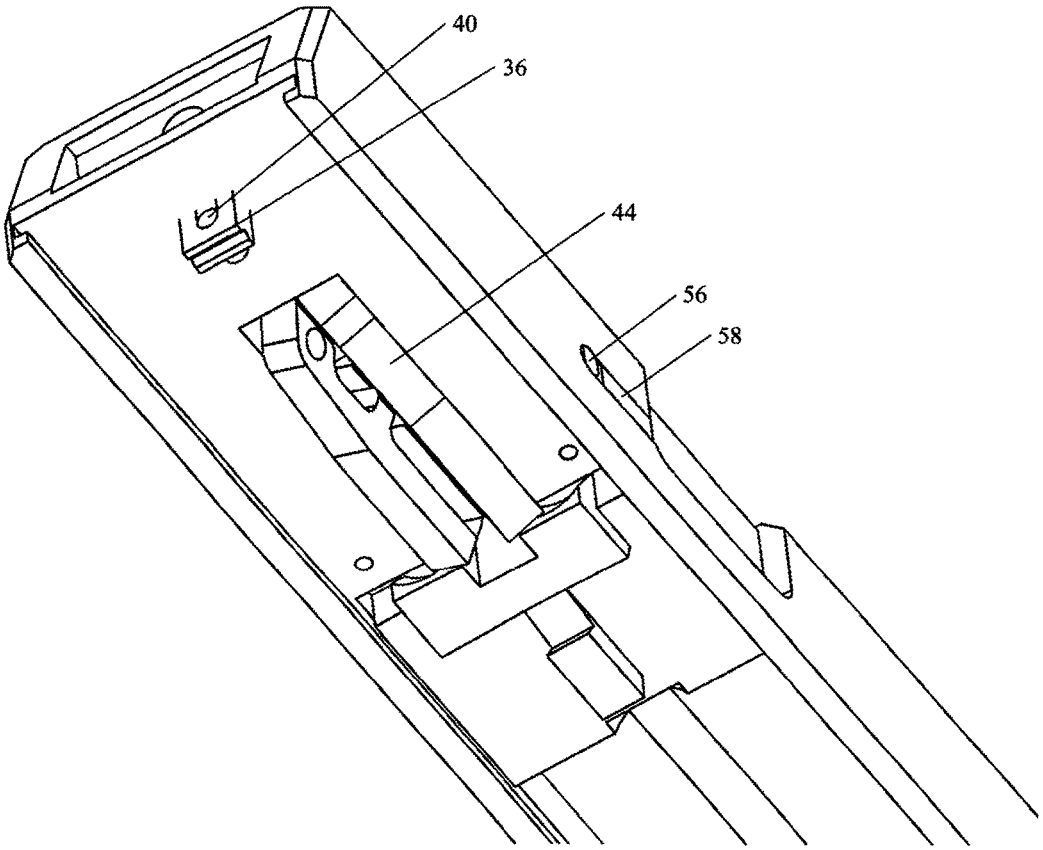
FIG. 6 is a diagram illustrating a bottom rear perspective view of a mechanism of a double-barreled firearm, in accordance with an embodiment of the present disclosure.

Referring to FIG. 6 and back to FIGS. 1-5, this diagram illustrates a bottom perspective of the slide 22 of the firearm 20, wherein the selector switch is disposed in the middle position and both feed bar assemblies 44 are pressed down by the selector rod 42 and engaged for use, in accordance with an embodiment of the present disclosure. In this embodiment, rounds are extracted by an extractor assembly 46. The extractor assembly 46 is configured to extract either spent or unspent cartridges from a chamber. The extractor assemblies 46 comprise two extractor claws 56, two claw pushrods 54, and a linkage 56 disposed between claw push rods 54. The extractor assembly 46 comprises a spring-loaded claw 58 configured to pivot in order to attach to a case lip for extraction of the cartridge. Providing a solution to the related art problems, the extractor assembly 46 is configured to selectively engage or disengage (selectively switch) either extractor claw 58 of the extractor claws 58. In single-barrel guns, this is not necessary; however, in the for doubled-barreled guns, two barrels are operable and the firearm 20 of the present disclosure is configured to leave one cartridge in the non-firing chamber, whereby an unfired cartridge is not ejected, and whereby the hitherto unfired cartridge is immediately ready to firing when the former non-firing chamber is selected as the current firing chamber. An advantage to the firearm 20 is that the firearm operator, e.g., a law enforcement "sharp-shooter" may switch ammunition type at a split second as appropriate for a given situation, e.g., switching from lethal ammunition to non-lethal ammunition upon realizing that a suspect is not actually armed or is armed with only a toy weapon.

Still referring to FIG. 6 and back to FIGS. 1-5, the selector switch 36 rotates the selector rod 42, whereby the linkage 56 slides from side to side, whereby the two claw pushrods 54 are selectively movable to enable one extractor claw 56 while simultaneously disabling the other extractor claw 56. Alternatively, the two claw pushrods 54 are selectively movable to enable one firing pin while simultaneously disabling the other firing pin. Regardless of the actual components and specific configurations as herein described, simultaneously disabling the firing pin and/or the extractor claw associated with one barrel and enabling firing pin and/or the extractor claw associated with the other barrel is encompassed by the present disclosure.

Still referring to FIG. 6 and back to FIGS. 1-5, when the selector switch 36 is pushed to a selected side, the selector rod 42 restricts the feed bar 46 and the extractor 44 associated with the non-selected barrel and disengages the retainer 48 on the selected side. The side selected and the corresponding restrictions and disengagements are selectively reversible and desirable, such as in an embodiment of the switch configured to removable couple with another lever making it easier to move. When the selector switch 36 is in the middle position, the selector rod 42 restricts the use of both feed bars 44, disengages the retainer 48 restriction, and facilitates engagement of both extractors. This embodiment may also have a carry/safe mode feature in the middle for facilitating ejection of ammunition from both chambers, load ammunition from both magazines, and prevent actuation of both firing pins.

Still referring to FIG. 6 and back to FIGS. 1-5, another embodiment of the firearm 20 is encompassed by the present disclosure and comprises a retainer 48 that prevents a cartridge from exiting its chamber while the bolt is cycled. This component is necessary to retain the cartridge in the non-fired chamber from slipping out of its chamber accidentally as the slide is moved rearward due to manual operation or through the automatic process of the firing of another chamber of the same firearm. The retainer 48 is inserted into the case lip of a cartridge on the non-fired side of the firearm. Without this component, the non-fired cartridge may slip out of the chamber during cycling of the gun which may lead to jams, accidental discharge, damage to firearm, damage to magazine, personal harm, etc. The retainer 48, as described in the present disclosure, is not disclosed in the related art involving single-barreled or multi-barreled guns; and a retainer, such as the retainer 48 is believed to overcome many of the challenges experienced in the related art.

Referring back to FIG. 4, this diagram illustrates a mechanism 33 of a double-barreled firearm 20, in accordance with an embodiment of the present disclosure.

Information as herein shown and described in detail is fully capable of attaining the above-described object of the present disclosure, the presently preferred embodiment of the present disclosure; and is, thus, representative of the subject matter; which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

INDUSTRIAL APPLICABILITY

The present disclosure industrially applies to the field of firearms. More particularly, the present disclosure industrially applies to firearms configured for projecting a plurality of ammunition types. Even more particularly, the present disclosure industrially applies to firearms configured for projecting a plurality of ammunition types involving non-lethal ammunition.

What is claimed:

1. A double-barreled firearm, comprising:

a slide having a slide body, a first barrel, a second barrel in parallel with said first barrel, and a firing chamber comprising a first firing chamber corresponding to the first barrel and a second firing chamber corresponding to the second barrel; wherein the slide comprises two feed bar assemblies in communication with the feed bar notch, each feed bar assembly of the two feed bar assemblies comprising a feed bar face;

two extractor assemblies in communication with the selector rod, each extractor assembly of the two extractor assemblies comprising an extractor claw and a claw pushrod;

a linkage in communication with each claw push rod; and a mechanism for selectively firing only one chamber of the first firing chamber and the second firing chamber, the mechanism comprising a selector switch having a selector switch channel and a selector rod in communication with the selector switch wherein the selector rod comprises a distal end, a proximal end, and a feed bar notch.

2. A double-barreled firearm, comprising:

a slide having a slide body, a first barrel, a second barrel in parallel with said first barrel, and a firing chamber comprising a first firing chamber corresponding to the first barrel and a second firing chamber corresponding to the second barrel; and a mechanism for selectively firing only one chamber of the first firing chamber and the second firing chamber, the mechanism comprising a selector switch having a selector switch channel and a selector rod in communication with the selector switch wherein the selector rod comprises a distal end, a proximal end, and a feed bar notch; wherein the selector rod's proximal end is configured to engage the selector switch channel such that, when said selector switch is pushed from side to side, the selector rod's proximal end is configured to travel along the selector switch channel, whereby the selector rod is configured to rotate.

* * * * *